US006250220B1

(12) United States Patent
Sainio et al.

(10) Patent No.: US 6,250,220 B1
(45) Date of Patent: Jun. 26, 2001

(54) ANTI-WRINKLE SYSTEM FOR A WEB OFFSET PRESS

(75) Inventors: Jeffrey W. Sainio, Milwaukee; Craig J. Peglow, Pewaukee; Alan D. Lasecki, Milwaukee, all of WI (US)

(73) Assignee: Quad/Graphics, Inc., Sussex, WI (US)

( * ) Notice: Subject to any disclaimer, the term of this patent is extended or adjusted under 35 U.S.C. 154(b) by 0 days.

(21) Appl. No.: 09/371,227

(22) Filed: Aug. 10, 1999

(51) Int. Cl.[7] ..... B65H 23/00

(52) U.S. Cl. ..... 101/228; 101/484; 101/488; 101/DIG. 42

(58) Field of Search ..... 101/219, 220, 101/225, 488, 424.1, 484, 247, DIG. 42; 492/39; 26/51, 71, 74, 75, 99, 105

(56) References Cited

U.S. PATENT DOCUMENTS

| | | | | |
|---|---|---|---|---|
| 3,724,737 | * | 4/1973 | Bodnar | 226/199 |
| 4,201,894 | | 5/1980 | McLaughlin | 370/58 |
| 4,330,909 | * | 5/1982 | Peschke et al. | 26/75 |
| 4,410,122 | * | 10/1983 | Frye | 226/199 |
| 4,566,162 | | 1/1986 | Brands | 26/105 |
| 4,726,293 | | 2/1988 | Ende | 101/228 |
| 5,024,156 | | 6/1991 | Hank et al. | 101/216 |
| 5,184,555 | | 2/1993 | Quadrucci et al. | 101/417 |
| 5,188,273 | | 2/1993 | Schmoock | 226/190 |
| 5,273,197 | | 12/1993 | Wenk | 226/190 |
| 5,607,039 | | 3/1997 | Byers et al. | 193/37 |
| 5,678,484 | | 10/1997 | Callan et al. | 101/226 |
| 5,729,878 | * | 3/1998 | Kurihara et al. | 26/101 |
| 5,791,030 | | 8/1998 | Aihara et al. | 26/87 |
| 6,058,844 | * | 5/2000 | Niemiec | 101/488 |

* cited by examiner

*Primary Examiner*—John S. Hilten
*Assistant Examiner*—Kevin D. Williams
(74) *Attorney, Agent, or Firm*—Michael Best & Friedrich LLP

(57) ABSTRACT

The invention relates to a system and method of eliminating wrinkling, tearing and web-breaks of a web in an offset printing press as the web contacts the chill rollers on start-up. The system operates to eliminate the wrinkling that generates the tearing. During startup, a spreader roller impinges the web, stretching out wrinkles. During acceleration of the press, when thermal contraction of the paper also achieves the desired stretching, the spreader roller is retracted to prevent smearing of ink on the web. Uneven pressure of the spreader is utilized to implement steering of the web to enhance web centering.

11 Claims, 4 Drawing Sheets

ANTI-WRINKLE SYSTEM FOR A WEB OFFSET PRESS

FIELD OF THE INVENTION

The present invention relates to a system and method for preventing wrinkling of a web in a web-offset press. More particularly, the invention relates to a system and method for preventing wrinkling, tearing, and web-breaks of a web as the web contacts a first chill roller after passage through a dryer, to thereby minimize press down-time.

BACKGROUND OF THE INVENTION

In a web-fed printing system such as a web-offset press, a series of repeating images are printed on a web of material, typically paper. In the typical process, the web is fed to sequential printing units, wherein each printing unit prints a different color ink on the web to produce a multi-color image. The web is subsequently fed to a thermal dryer which dries the ink and is then routed to a series of chill rollers which operate to cool the web and set the ink. The web is next slit in the longitudinal direction (the direction of web movement) by a slitting mechanism to produce a plurality of continuous ribbons. The ribbons are directed to a folder wherein the ribbons are aligned one on top of the other, folded longitudinally, and then cut laterally to produce a plurality of multi-page, approximately page-length segments, each of which is termed a "signature". The signatures are subsequently bound together to produce magazines, catalogs, or other printed products.

As the art of web-offset high-volume printing has progressed, publishers have migrated to the usage of lighter basis-weight paper for the printing of magazines, catalogs, and coupons. Lightweight paper has a lower cost per impression, as well as lower postal mailing costs.

SUMMARY OF THE INVENTION

Such lightweight paper has been found to yield an acceptable level of quality in terms of print density and opacity, and is gaining popularity. As schematically illustrated in FIG. 2, however, a serious problem in the usage of this paper is the formation of wrinkles or creases 44 or the like as the web emerges from the dryer and wraps around the first chill roller 33 during start-up of the press. Because the web 14 is unsupported in the long span of the dryer, it tends to form corrugations 48. These corrugations 48 decrease the effective width of the web.

During start-up, when the web 14 moves to contact the first chill roller 33, these corrugations 48 must flatten out. Because the width of the web as laid down on the chill roller is slightly less than the true width of the web, the excess paper manifests as creases 44 substantially parallel to the long axis 46 of the web 14. A crease is raised in a direction away from the center of the chill roller 33. As the paper wraps around the circumference of the chill roller 33, the raised portion of the paper is now describing a semicircle whose radius is larger than the paper which is lying flat on the surface of the chill roller 33. The creased paper is consequently stretched, and lighter weight paper is often sufficiently weak such that it will rip. The crease 44 can create a series of small rips 50 in the paper, every few inches along the crease.

The numerous small rips 50 in the paper can be the initial point of a web-break, especially if the rip happens to occur in the region of the web which will be longitudinally slit to form ribbons of lesser width. A rip encountering the slitting mechanism can result in a failure of the slitting mechanism with resultant web-break, or a ribbon with a torn edge can be greatly weakened, resulting in a higher probability of breakage under tension as the rip passes through the folder.

During normal running of the press, creases in the web present a much lesser problem. When the press is running at full speed, the web travels from the dryer to the first chill roller so quickly that the web is still hot. The web is cooled and resultant thermal shrinkage occurs quickly on the first chill roller. The shrinkage to a large extent eliminates the creases before ripping occurs.

Spreader rollers are commonly used on printing press in-feeds to remove wrinkles from the web before the web is fed to the printing units. Spreader rollers are well known in the art; see, for example, U.S. Pat. Nos. 4,566,162, 5,607,039, and 5,729,878. The design of a spreader roller can be as simple as a handmade application of adhesive tape, wound in two separate helical patterns on an existing roller. The helical patterns operate to carry wrinkles toward the edges of the web.

Another problem, particularly severe in the case of lightweight paper, is poor lateral stability of the paper under conditions of low web tension. During normal operation of the press, if the web should break, the web is subsequently re-threaded through the press, with a handmade splice at the point of breakage. Such splices have poor strength and would pull apart if subjected to a tension typically used for the paper. Thus, a lower tension is used until the splice has passed through the press. The combination of lightweight paper and lower tension causes poor lateral stability of the web. During slow speed operation of the press, the web may slowly creep off-center to either side of the chill rollers, falling partially off the edge of the roller. The wrinkled paper will generally break, causing additional downtime re-webbing the press. During start-up, a pressman may manually hold the paper and pull it to remove creases and prevent crawling toward either side, but this action requires valuable manpower, and requires skill to avoid accidentally ripping the paper.

There is a need to prevent the formation of creases on the web and prevent lateral instability of the web during the period of press start-up when the web is moving too slowly for the paper to remain hot enough at the point that the web first contacts the first chill roller.

An object of the present invention is to provide a mechanism for the restoration of web width prior to the first chill roller during start-up, to prevent wrinkling and tearing of the web with resultant web-breaks and press downtime.

A further object of the invention is to retract the web-width restoration mechanism during normal running of the press, to avoid marring the hot ink on the web.

A yet further object of the invention is to pull the web in a manner that prevents the paper from traveling off-center of the rollers far enough to reach the edges of the chill rollers and the various other rollers in the web path after the dryer.

Other features and advantages of the invention will become apparent to those of ordinary skill in the art upon review of the following detailed description, claims, and drawings.

Figures 1, 2:
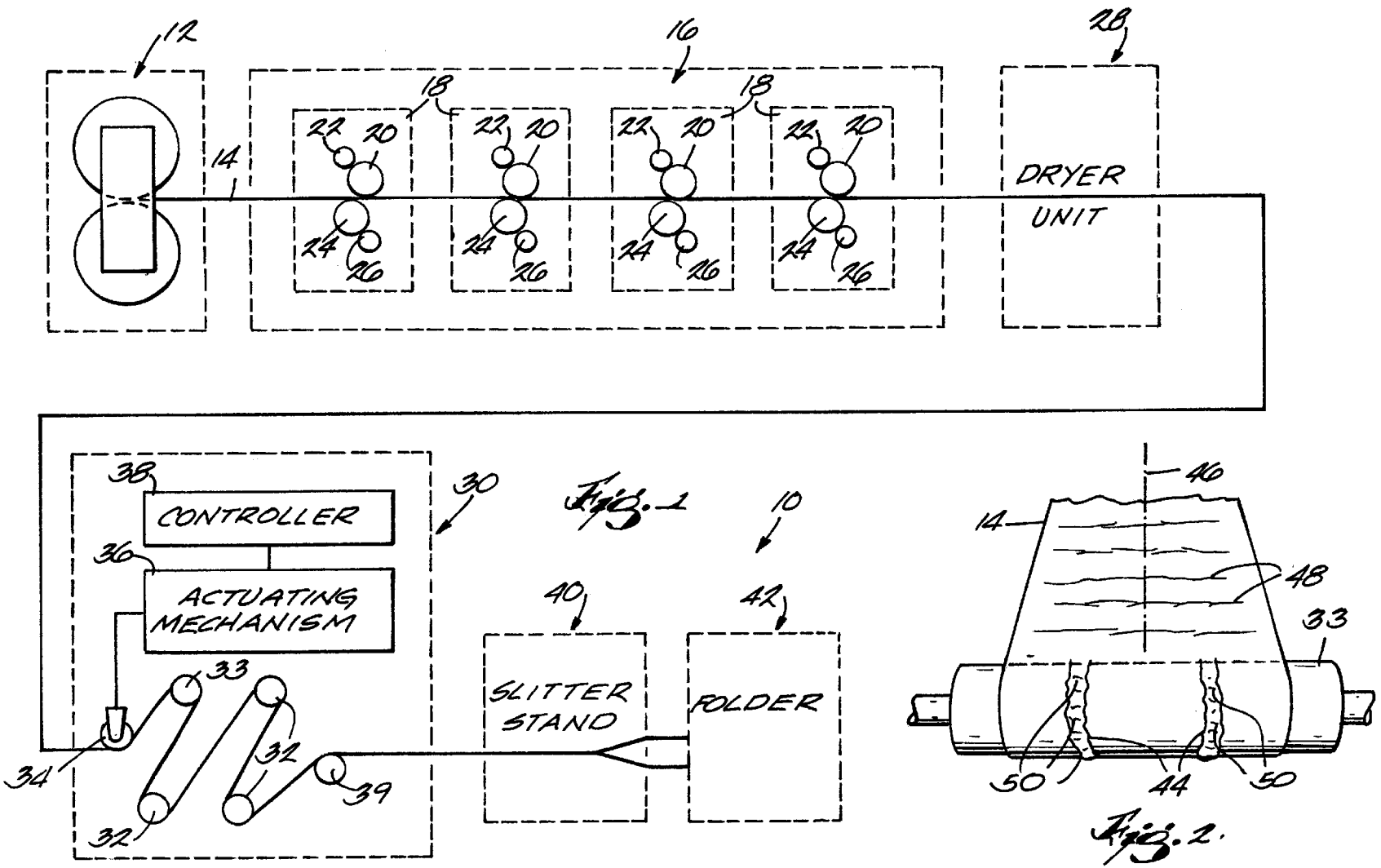
FIG. 1 is a diagram of a heat-set offset-web printing press line.
FIG. 2 is a diagram of the formation of a crease or wrinkle in a web as the web encounters a chill roller.
Figure 3A:
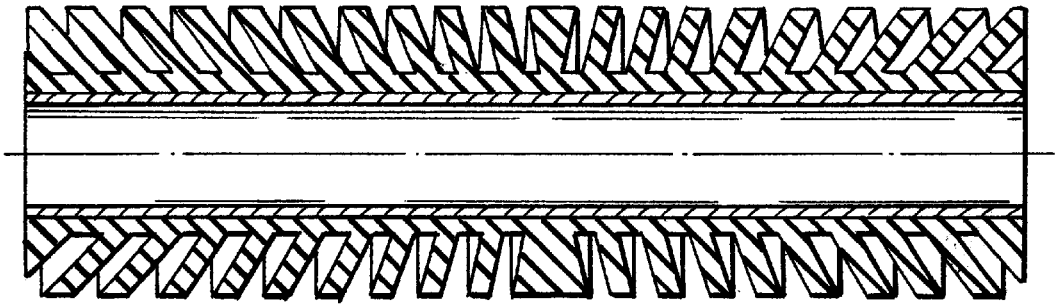
Fig. 3a PRIOR ART
FIGS. 3(*a*)–3(*e*) illustrate various prior art embodiments of a spreader roller.
Figure 3B:
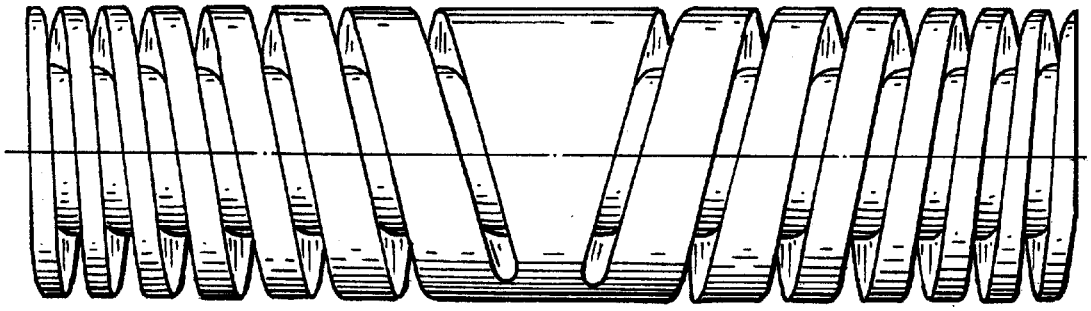
Fig. 3b PRIOR ART
Figure 3C:
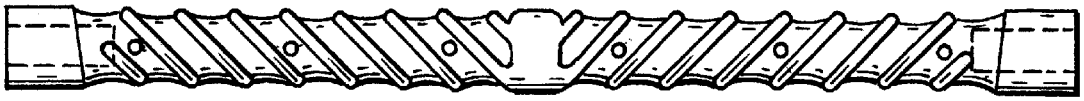
Fig. 3c PRIOR ART
Figure 3D:
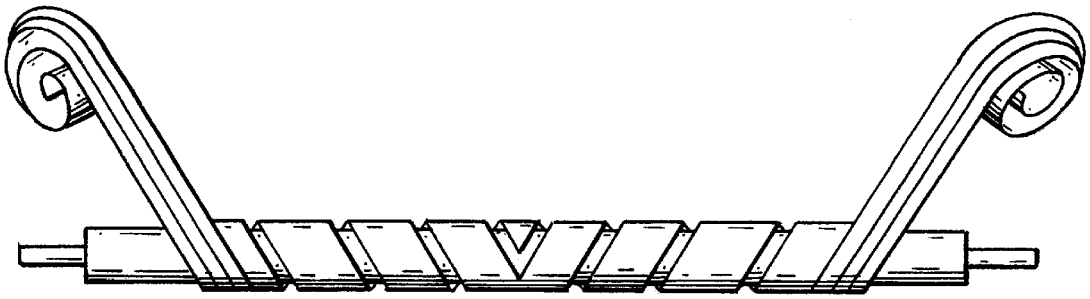
Fig. 3d PRIOR ART
Figure 3E:
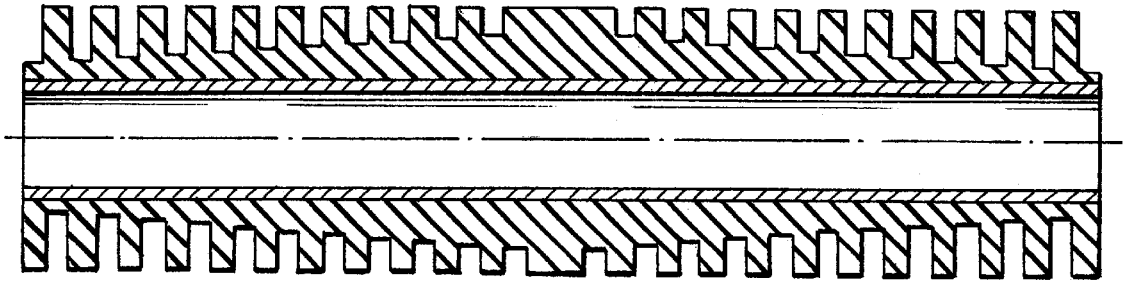
Fig. 3e PRIOR ART

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in FIG. 1 is a portion of a typical multicolor web-fed printing press line 10. A web of material 14 (e.g. paper) is sequentially driven from a reel stand 12 through a press 16 which includes a plurality of printing units 18. Each printing unit 18 includes an upper blanket cylinder 20, an upper plate cylinder 22, a lower blanket cylinder 24, and a lower plate cylinder 26. The printing units 18 cooperate to print multi-color images on the upper and lower surfaces of the web 14. Each printing unit 18 prints an associated color of ink. The desired image is repeatedly printed on the web 14 as the web 14 travels in a longitudinal direction past the printing units 18.

The web is next suitably guided through a dryer unit 28 and a chill unit 30. The chill unit 30 includes a plurality of chill rollers 32 as well as a spreader roller 34. The spreader roller 34 is mounted to be lowered into the web path and retracted therefrom by an actuation mechanism 36. A controller 38 such as a programmable logic controller controls the positioning of the spreader roller 34 via the actuation mechanism 36.

The web is next routed by idler rollers 39 to other web processing units such as a slitter stand 40 and a folder 42. The slitter stand 40 includes a slitting mechanism (not shown). As the web travels in a longitudinal direction, the slitting mechanism operates to slit the web in a direction substantially parallel to the direction of web movement into two or more ribbons. The folder 42 includes angle bars (not shown) which operate to align ribbons one on top of the other. The folder 42 also operates to longitudinally fold the ribbons. The folder 42 also includes a cutting mechanism (not shown) which operates to cut the folded ribbons in a direction transverse to the direction of web movement at the appropriate time in order to properly separate the repeating images on the web 14 with respect to the position of ink on the web.

In the preferred embodiment, chill roller 33 is the first roller the web encounters after the web 14 exits the dryer 28. As previously stated, the spreader roller 34 is positioned to be lowered into contact with the web 14 and retracted therefrom.

As shown in FIGS. 3(*a*)–3(*e*), the spreader roller can take a variety of forms. For example, these figures illustrate spreader rollers having a rigid core and a covering surrounding the core. In FIG. 3(*a*), the covering is compliant and includes a pair of helical grooves wherein the angle of the groove with the axis of the spreader roller progressively decreases as each groove spirals from the roller center line to one of the roller ends. FIG. 3(*b*) illustrates a roller wherein the width of the covering portions between the grooves progressively decreases in the direction from the roller center line to one of the roller ends. FIG. 3(*e*) illustrates a spreader roller having a covering including a pair of helical grooves which spiral outward from the center of the roller and wherein the depth of each helical groove progressively increases with the distance from the roller center line to one of the roller ends.

Figure 4:
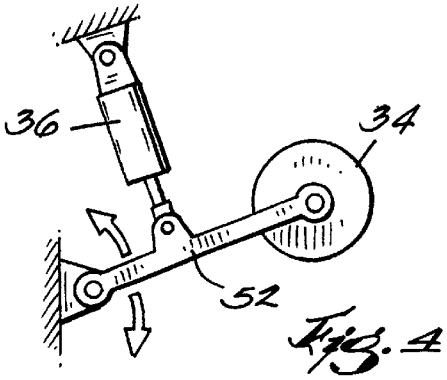
FIG. 4 is a side view of the actuating mechanism which moves the spreader roller into and out of engagement with a web on a printing press line.
Figure 5:
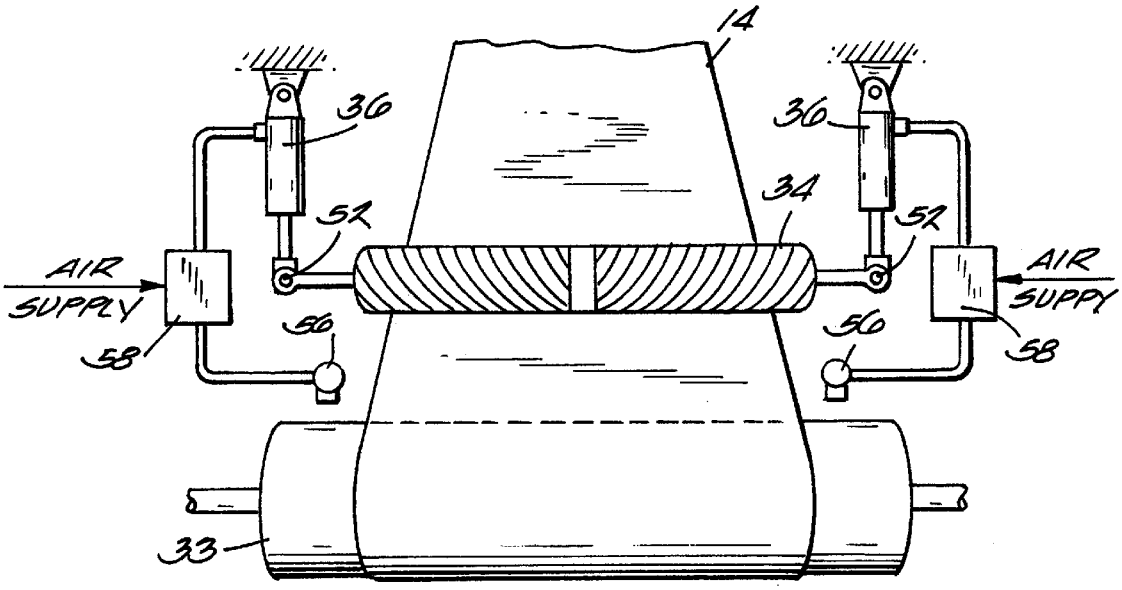
FIG. 5 is an end view of a portion of a web on a printing press that includes a chill roller and a spreader roller positioned immediately before the chill roller.

As best seen in FIGS. 4 and 5, the spreader roller 34 is supported by lever arms 52 on either side of the web, and each arm 52 is moved by an actuation mechanism 36 into and out of contact with the web. The actuation mechanism may be, for example, a pneumatic actuator such as part number 2000TR-1013, manufactured by American Cylinders of Chicago, Ill.

Referring again to FIG. 1, during web-up of the press, the actuation mechanisms 36 pull the spreader roller 34 away from the chill roller 33, to avoid impeding the threading operation. When the web reaches a pre-selected speed, the reel stand 12 applies tension to the web 14. This tension would be sufficient to generate rips in any wrinkles in the web at the chill roller 33. At the time the reel stand 12 applies tension, the actuation mechanisms lower the spreader roller 34 into contact with the web, so that the spreader roller 34 spreads the web 14 and eliminates the wrinkles. As the press accelerates to normal printing speed, the web 14 is still hot when it exits the dryer unit 28 and reaches the chill unit 30. The web shrinkage now performs the equivalent of the spreading operation, and the spreader roller 34 is retracted by the actuation mechanism to avoid marring the hot ink printed on the web.

Figure 6:
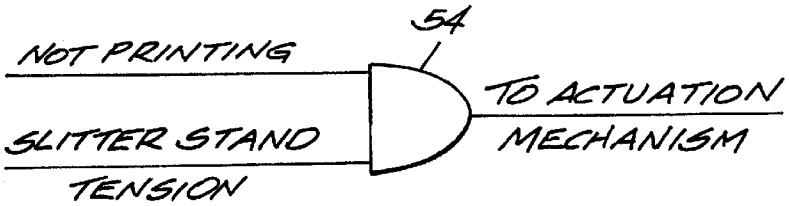
FIG. 6 is a schematic of logic elements in the press control system which control the retraction mechanism.

FIG. 6 illustrates an example of the logic in the controller 38. Logic gate 54 acts as an AND gate to control the actuation of the spreader roller 34. The AND gate has a first input a signal indicative of slitter stand tension, and a second input a signal indicative of whether or not the printing units are applying ink. Thus, for example, engagement of the spreader roller 34 in the web path occurs if the web 14 is at a higher tension than that used when the press is hand-webbed, and the printing units 18 are not applying ink. The engagement of the spreader roller 34 is undesirable during hand-webbing of the press, as it impedes easy threading of the web. The logic gate 54 may be implemented as a logic rung in a Programmable-Logic controller, which is generally already present to control the press. Many alternatives may be used to control the actuation of the spreader roller 34 other than tension and ink application signals. For example, a speed set-point could also be used, wherein the selected set-point is typical of the press speeds at which tension and printing, respectively, occur. The only requirement is that the spreader roller 34 be disengaged while normal printing is occurring.

Referring to FIG. 5, a further advantage of using a spreader roller similar to that shown in FIG. 3(*a*) is realized with the utilization of a pair of web-sensors 56 positioned on respective sides of the spreader roller 34. The web-sensors 56 may be implemented as using sensing methods such as sonar, infrared, retro-reflecting, or other sensing methods as are known in the art. The sensors 56 operate to track the position of the web. For example, if the web 14 should deviate from the desired center position with respect to the chill roller 33, sensor 56 measures the deviation. A signal from sensor 56 engages a pressure-reducing valve 58, reducing the actuation pressure of the actuation mechanism 36 that is on the same side as the sensor 56. The decreased pressure on one side of the spreader roller 34 causes the angled ridges of the roller 34 to perform less effectively on that side. A net pull of the web 14 is accomplished, effectively re-centering the web. Web-breaks due to poor centering are therefore minimized.

The web 14 may be so slack that the angled ridges of the roller depicted in FIG. 3(*a*) are not compressed sufficiently to create lateral forces on the web. To overcome this difficulty, the spreader roller 34 is positioned at a small distance from the chill roller 33. With sufficient web tension, the force of the actuation mechanism 36 causes the spreader roller 34 to impinge into the web a distance insufficient to trap the web between the spreader roller 34 and the chill roller 33. At the area of contact with the spreader roller 34, the web 14 is unimpeded by friction against the chill roller 33, so the spreading action is optimal. However, during conditions of slack web, the force of the actuating mechanism causes the spreader roller 34 to "bottom out" against the chill roller 33. This bottoming out causes pressure on the angled ridges of the spreader roller 34. A lateral web-centering force is therefore still created, generating sufficient centering motion.

It is to be understood that the invention is not confined to the particular construction and arrangement of parts herein illustrated and described, but embraces all such modified forms thereof as may come within the scope of the following claims. It will be apparent that many modifications and variations are possible in light of the above teachings. Therefore, it is to be understood that within the scope of the appended claims, the invention may be practiced other than is specifically described.

Alternative embodiments and variations of the method taught in the present specifications may suggest themselves to those skilled in the art upon reading the above description. In particular, the example of a single-web press has been described for clarity, but the invention pertains to a multi-web press as well. The invention should not be constrained to the types of spreader rollers illustrated and described, but to any roller whose function is to spread a web. Although pneumatic actuators operating the spreader roller with lever arms is described, any of a number of arrangements are known in the art, which are capable of impinging a roller into a web. For example, a direct mechanical actuation of an electrical solenoid, or a chain drive, could also be employed. Also, any of a variety of actuation parameters, such as press speed, web color, or web temperature, could be used as criteria for removal of the spreader roller from the web, upon initiation of printing.

Various other features and advantages of the invention are set forth in the following claims.

What is claimed is:

1. A method for the removal of wrinkles from a web at chill rollers of an offset printing press, comprising:

detecting a condition of web motion in a web path during start-up;

in response to said condition, moving a spreader roller into the web path to impinge the spreader roller into the web at a point between a dryer and the chill rollers thereby spreading the web; and removing said spreader roller at the commencement of normal printing.

2. The method of claim 1 further comprising the steps of:

sensing an off-center condition of the web on one side of the web;

in response to said off-center condition, diminishing the relative amount of the spreading of the web on the same side of the web of the off-center condition, as compared to the amount of the spreading of the web on the opposite side of the web.

3. The method of claim 1 wherein the spreader roller is moved into the web path by an actuation mechanism that includes actuators connected to opposing ends of the spreader roller.

4. The method of claim 1 wherein the spreader roller is moved into the web path before the web offset printing press has begun printing.

5. A method for removing wrinkles from a web travelling along a web path through an offset printing press, the method comprising:

providing a spreader roller;

moving the web along the web path;

detecting a condition of web motion in a web path during start-up; and in response to said condition, moving the spreader roller into the web path such that the spreader roller spreads the web.

6. The method of claim 5 further comprising moving the spreader roller out of the web path such that the spreader roller no longer spreads the web.

7. The method of claim 6 wherein the spreader roller is moved from the web path before the web offset printing press has begun normal printing.

8. The method of claim 5 further comprising sensing the web to determine whether the web needs spreading, and wherein the spreader roller is moved into the web path after determining that the web is in need of spreading.

9. The method of claim 8 wherein the web sensing is done by monitoring the width of the web.

10. The method of claim 8 wherein the web sensing is done by monitoring the speed of the web.

11. The method of claim 8 wherein the web sensing is done by monitoring the tension of the web.

* * * * *